United States Patent [19]

Newlin, Jr.

[11] Patent Number: 4,685,668

[45] Date of Patent: Aug. 11, 1987

[54] WEIGHTLIFTING BELT

[76] Inventor: Thomas L. Newlin, Jr., 4310 Valparaiso, Pasadena, Tex. 77504

[21] Appl. No.: 924,747

[22] Filed: Oct. 30, 1986

[51] Int. Cl.[4] ..... A63B 13/00

[52] U.S. Cl. ..... 272/123; 272/143; 2/338

[58] Field of Search ..... 272/123, 93, 143; 128/68, 69, 78; 2/338, 336, 323, 311

[56] References Cited

U.S. PATENT DOCUMENTS

| | | | |
|---|---|---|---|
| 2,132,616 | 10/1938 | Hardie | 2/338 |
| 2,602,932 | 7/1952 | Eaton | 2/338 |
| 3,920,008 | 11/1975 | Lehman | 128/78 X |
| 4,348,774 | 9/1982 | Woodson | 2/338 |
| 4,509,214 | 4/1985 | Shea | 2/338 X |

*Primary Examiner*—Dave W. Arola
*Attorney, Agent, or Firm*—Vaden, Eickenroht, Thompson & Boulware

[57] ABSTRACT

A weightlifting belt made of nylon webbing is disclosed, wherein the belt body is of heavy duty material subject to stretching. Backing strips of regular duty material of a construction that is not stretchable and a holding strap are sewn to the belt body using a plurality of stitching lines that defeat the stretchability of the belt body. Elongate hook-and-loop strips are sewn in the combination with the backing strips, one sewn to the body combination and the other to the loose end of the holding strap. A buckle is also held into the body combination by a looped and sewn end of the holding strap.

11 Claims, 2 Drawing Figures

WEIGHTLIFTING BELT

BACKGROUND OF THE INVENTION

1. Field of the Invention

This invention pertains to belts employed by weightlifters to protect the lower torso against kidney and lower back damage.

2. Description of the Prior Art

Serious body builders and weightlifting competitors are well aware that the lower torso should be supported by a belt when working out with heavy weights and during competition with heavy weights. Not only are the muscles in that area of the body subject to possible strain but the kidney must be supported against damage resulting from the internal pressures that build up in that area of the body with the lifting of very heavy weights.

Protective gear used in competition is regulated by such associations as the Power Lift Association, the AAU, the NCAA and others. Generally, the standards designate a belt limited to four inches in width and a belt that does not significantly stretch with the bulging of the muscles during workouts and competitions. In addition, it is highly desirable that the edges of the belt do not curl. It should be further noted that although a 4-inch wide belt is generally standard for competition, wider belts are sometimes preferred by users during workouts on the theory that by supporting a wider body area, the risks attendant to being not adequately supported are reduced.

The material that has heretofore been used to satisfy all of the requirements of weightlifting belts for competition and in practice is leather. That is, leather is available in heavy duty thicknesses to resist stretching. A leather belt does flex enough, however, to readily accommodate to the waist. Moreover, heavy duty leather will not substantially curl.

The main drawback of leather is that it is relatively expensive when compared to some artificial heavy duty materials, such as nylon webbing. Moreover, leather comes in two rather drab colors, namely, brown and black. In addition, leather does discolor or stain with sweat and does not become clean when washed. In fact, leather deteriorates when washed and hence washing is not recommended. Finally, leather does age and crack and becomes worn out rather quickly when used and put under strain on a daily basis.

Therefore, it is a feature of the present invention to provide an improved weightlifter's belt made of a cloth material, rather than leather.

It is another feature of the present invention to provide a weightlifter's belt what is durable, readily washable and which can be offered in a variety of colors or designs.

SUMMARY OF THE INVENTION

A weightlifting belt in accordance with the present invention comprises a belt body of heavy duty material webbing, preferably nylon, connected by appropriate stitching to suitable backing and holding strips or straps to regidify the belt body against stretching. Suitable hook-and-loop or Velcro® strips are provided to the holding strap and the belt body and a suitable buckle is provided for the holding strap to slip through.

The backing strips and the holding strap are preferably provided in desirable color. The color can be coordinated with the color employed on other belts to designate size, the weight classification of the competitor using the belt, an achievement level of the user or the like.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a preferred embodiment of the invention and are therefore not to be considered limiting of its scope as the invention may admit to other equally effective embodiments.

IN THE DRAWINGS

Figure 1:
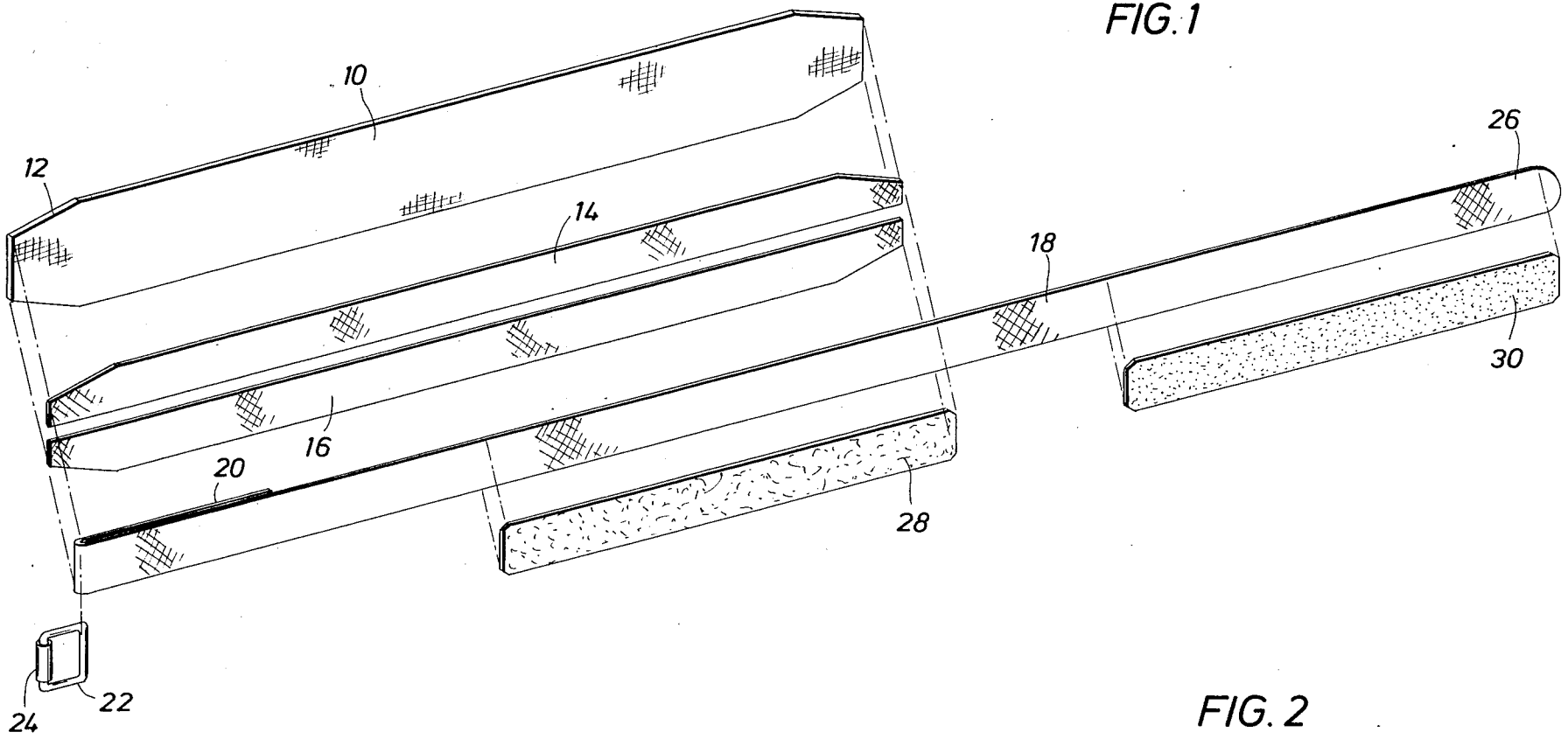

FIG. 1 is an exploded view of the various pieces comprising a weightlifting belt in accordance with a preferred embodiment of the present invention.

Figure 2:
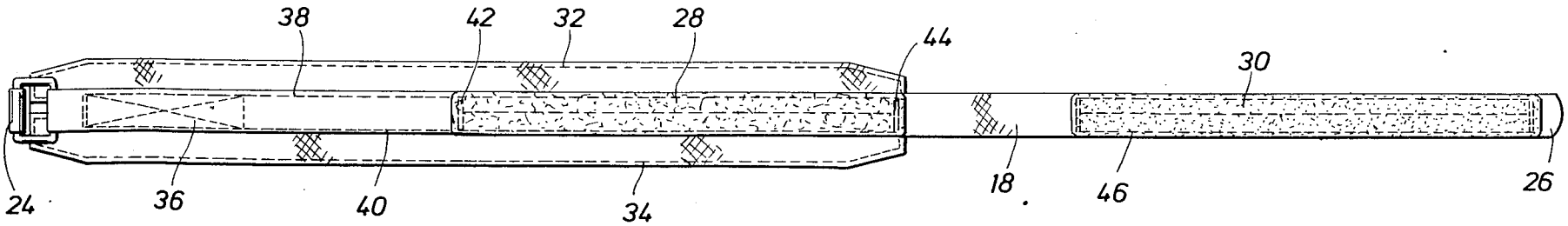

FIG. 2 is a front view of the assembled belt shown in FIG. 1.

DESCRIPTION OF THE PREFERRED EMBODIMENT

Now referring to the drawings and first to FIG. 1, an exploded view of a preferred embodiment of the weightlifting belt is shown. A wide belt body 10 is shown, which has a length less than the distance around the user's waist. The preferred material is a heavy duty nylon webbing used in such applications as slings for lifting heavy articles and as tie-down straps for fastening loads to flat bed trucks. One heavy duty webbing of this type has tested to loads up to 7500 psi. The preferred width of belt body 10 is four inches, since this is the width of belts sanctioned for competition. However, webbing of the type just described is available in 1-inch increments. Therefore, a 1-inch narrower or a 1-inch wider belt body is readily available from standard webbing supply.

A webbing of the type just described includes a ribbed construction that allows it to stretch under loads without breaking. This feature is highly desirable for the prior art uses of this webbing material mentioned above.

For purposes of making the belt body, each of four corners 12 are angle cut and subsequently heat or chemically melted to prevent fraying. Alternatively, these corners can be suitably bound for the same purpose.

Backing strips 14 and 16 of regular duty nylon webbing material is then cut, such webbing being readily available from stock used for seat belts and the like. This webbing material is not ribbed and, therefore, does not stretch. It is tested typically to restrain loads of about 1100 psi. Strip 14 is trimmed at its ends to correspond with the cut ends along the top edge of belt body 10 and strip 16 is trimmed at its ends to correspond with the cut ends along the bottom edge of belt body 10. The widths of each strip 14 and 16 are preferably equal. The length of the strips are the same as belt body 10 and the combined widths of the strips is slightly less than belt body 10. Hence, for use with a 4-inch wide belt body 10, each strip 14 and 16 are typically $1\frac{7}{8}$ inches wide.

Another strip 18 to be employed as the holding strap is made from the same webbing stock as strips 14 and 16. Preferably, the length of this strip is about twice the length of the belt body, although any length is acceptable that is suitable to perform the various functions of the strap. A first end 20 of strap 18 is folded over to a length of about 4–5 inches after being folded around a suitable rectangularly shaped buckle 22. If the strap is $1\frac{7}{8}$ inches wide, the dimension of the opening of the buckle is slightly larger, for example, two inches. A sleeve 24 encloses the leg of buckle 22 opposite that covered by belt 18 in folding end 24 thereover. Sleeve 24 acts as a roller for receiving loose end 26 of strap 18.

A hook, loop-and-hook or Velcro® strip 28 that is slightly less than one-half the length of belt body 10 is cut for sewing onto holding strap 18. This strip is equal in width to the holding strap. A loop, loop-and-hook or Velcro® strip 30 of equal size is positioned for sewing to loose end 26 of strap 18 starting at a point behind the tip of end 26. This leaves an unbacked tip end of the strap.

The sewing together of the parts is by nylon thread. Typically strips 14 and 16 are first sewed to body belt 10 along their respective edges by stitched lines 32 and 34. Strap 20 with buckle 22 enclosed in end 20 is centered and connected by stitching 36 in a "box X" pattern. That is, the stitching is in a rectangle and then from corner to corner. The remainder of strap 18 aligned along belt body 10 is stitched along its outer edges at lines 38 and 40, these latter stitches also attaching strip 28 into the combination. Appropriate end stitching 42 and 44 on strip 28 completes the stitching pattern in the belt body portion.

Loop strip 30 is secured to end 26 by rectangular stitching 46, there being an end tip that is not covered by strip 30. If desired, both strips 28 and 30 can have an additional stitching line intermediate the outside stitching lines previously described.

Alternatively to first attaching strips 14 and 16 to belt body 10 before subsequently sewing strap 18 thereover, the multiple layers can all be stacked at one time and stitched together simultaneously.

In use, the belt is put around the waist, the loose tip end of strap 18 is inserted through the buckle and the belt is tightened so that most of strips 28 and 30 match up for holding purposes.

It is important to note that the ribbed portion of the webbing of belt body 10 is crosswise to the longitudinal dimension of the belt. The stitching of stitches 32, 34, 38 and 40, together with strips 14 and 16 and strap 18, prevent the webbing from elongating and thereby provide a suitable belt for weightlifting purposes. The belt is flexible enough to adjust to the waist, while stout enough to provide support. It is suitably non-streachable. The nylon material used for strips 14 and 16 and strap 18 permit the belt to be offered in a variety of colors. Further, it can be readily decorated or marked with distinctive designs. A color code can be developed for distinguishing between belt sizes, or to distinguish achievement levels, or to designate weight categories of competition. Also, the nylon construction permits washing of the material when the belt becomes soiled through use.

While a particular embodiment of the invention has been shown and described, it will be understood that the invention is not limited thereto. Many modifications maybe made, which will become apparent to those skilled in the art. For example, the buckle can be of a nylon material, if desired. Also, the loop-and-hook strips can be reversed, if desired, the loop strip being included in the combination sewn together with the belt body.

What is claimed is:

1. A weightlifting belt, comprising a wide belt body of heavy duty, laterally flexible and stretchable webbing material, first and second backing strips of regular duty webbing material equal in length with said belt body, each backing strip being equal to slightly less than half the width of said belt body, a holding strap of regular duty webbing material approximately equal in length to twice the length of said belt body and about as wide as said backing strips, a hook loop-and-hook strip equal in width to said holding strap and equal in length to about one-half of said belt body, a loop loop-and-hook strip equal in width and length to said hook strip, a loop buckle suitable for accommodating to said holding strap, said backing strips backing said belt body and aligned along the respective top and bottom edges of said belt body, said holding strap being centered over said backing strips, a first end looped through said loop buckle and folded along said belt body and at one end thereof, one of said hook and loop strips backing said holding strap at the other end of said belt body, the other of said hook strip and loop strip backing said holding strip from a starting point near its tip end, and stitching of said backing strips to said belt body along their outer edges, of said holding strap folded end, of said holding strap to said backing strips and body belt, and of said hook strip and loop strip to said holding strap, said stitching, backing strips and holding strap rigidifying said belt body against the tendency to flex and stretch to firmly support the user of the belt.

2. A weightlifting belt in accordance with claim 1, wherein said backing strips and holding strap are colored.

3. A weightlifting belt in accordance with claim 1, wherein said belt body is four inches wide.

4. A weightlifting belt in accordance with claim 1, wherein said belt body material is rated at 7500 psi.

5. A weightlifting belt in accordance with claim 1, wherein the material of said backing strips and holding strap is rated at 1100 psi.

6. A weightlifting belt in accordance with claim 1, wherein said holding strap is about two inches wide.

7. A weightlifting belt in accordance with claim 1, wherein said loop buckle is steel and has a straight outer leg and includes a roller sleeve over said outer leg.

8. A weightlifting belt in accordance with claim 1, wherein said loop buckle is nylon.

9. A weightlifting belt in accordance with claim 1, wherein said belt body and said backing strips are nylon, said ends thereof being angle cut and heat melted to prevent fraying.

10. A weightlifting belt in accordance with claim 1, wherein said stitching includes at least four stitching lines traversing the length of said belt body.

11. A weightlifting belt in accordance with claim 10, wherein said stitching includes six stitching lines.

* * * * *